US005551892A

United States Patent [19]

Endo et al.

[11] Patent Number: 5,551,892

[45] Date of Patent: Sep. 3, 1996

[54] WATER-PROOF CONNECTOR AND DUMMY PLUG FOR WATER-PROOF CONNECTOR

[75] Inventors: Takayoshi Endo; Hitoshi Sakai; Hitoshi Saito, all of Shizuoka, Japan

[73] Assignee: Yazaki Corporation, Tokyo, Japan

[21] Appl. No.: 327,906

[22] Filed: Oct. 24, 1994

[30] Foreign Application Priority Data

Oct. 27, 1993 [JP] Japan ..... 5-268950

[51] Int. Cl.[6] ..... H01R 13/40

[52] U.S. Cl. ..... 439/587; 439/589

[58] Field of Search ..... 439/519–521, 439/271–273, 587, 589, 592, 595

[56] References Cited

U.S. PATENT DOCUMENTS

| | | | |
|---|---|---|---|
| 4,810,208 | 3/1989 | Hayes et al. | 439/589 |
| 4,973,268 | 11/1990 | Smith et al. | 439/595 |
| 5,151,045 | 9/1992 | Cravens et al. | 439/587 X |

FOREIGN PATENT DOCUMENTS

| | | |
|---|---|---|
| 2-56786 | 12/1990 | Japan . |
| 374482 | 7/1991 | Japan . |
| 5-3065 | 1/1993 | Japan . |
| 5-59762 | 8/1993 | Japan . |

*Primary Examiner*—Khiem Nguyen

*Attorney, Agent, or Firm*—Armstrong, Westerman, Hattori, McLeland & Naughton

[57] ABSTRACT

A dummy plug is composed of a shielding plug to be inserted in a terminal accommodating chamber and a shielding plug holding means, wherein the shielding plug holding means further comprises; a lid portion which is formed larger than an inner diameter of the terminal accommodating chamber, a pushing projection for pushing the shielding plug formed on one side surface of the lid portion, and a housing locking section formed integrally with the lid portion. With the construction above, when the shielding plug is pressed by the pushing projection to be inserted into the terminal accommodating chamber and the housing locking section thereof is engaged with a locking claw provided at the outer circumferential surface of the connector housing, the pushing projection and the housing locking section can be observed from outside, and the location of the shielding plug stuffed in the terminal accommodating chamber can be consistent, so that even a conventionally adopted connector terminal checking tool can be used.

6 Claims, 4 Drawing Sheets

WATER-PROOF CONNECTOR AND DUMMY PLUG FOR WATER-PROOF CONNECTOR

BACKGROUND OF THE INVENTION

1. Field of the Invention

The present invention relates to an improvement of a water-proof connector and a dummy plug for use in a water-proof connector.

2. Description of the Prior Art

Generally, a multi-terminal water-proof type connector (hereinafter just referred to as a water-proof connector) contains a plurality of individually separated terminal accommodating chambers, wherein dummy plugs are required to shut up unused chambers which are generated due to addition and/or abolition of optional circuits.

FIG. 7 denotes an example of a conventional water-proof connector, in which a female terminal c is firmly fitted into a terminal accommodating chamber b of a connector housing a, and a lead wire d connected to the female terminal c is drawn outward by way of a lead wire through-hole e1 formed in the central portion of a sealing plug e. Stuffed in another terminal accommodating chamber b' is a dummy plug having no through-hole formed therein.

It is necessary to detect whether or not dummy plugs are already stuffed in empty terminal chambers so that there should be no chambers remained unplugged. However, it is not an easy job to detect it from outside due to the fact that each of the dummy plugs e' is inserted rather deep inside the individual terminal accommodating chambers b', and also due to the difference of the respective locations of the dummy plugs in each of the terminal accommodating chambers. In order to complete the detection thereof, there has been provided such a device as disclosed in Japanese Patent Application Laid Open No. 5-3065 and Japanese Utility Model Application Laid Open No. 5-59762, in which a water-proof connector is settled in the main body of the device which is capable of airtightly keeping the inner ambient and provided with pressurized air therein, whereby the existence of stuffed dummy plugs is detected by a change of the inner air pressure. The device as constructed as above, however, is rather cost consuming as it requires precision machinery components such as a pressurizing means, a pressure sensor and so on.

Apart from the above device, there has been provided a connector terminal detecting tool as disclosed in Japanese Patent Publication NO. 2-56786, which can be adopted even for a connector provided with a spacer for terminal double-locking operation normally disposed at a side surface or back surface of the housing, wherein it is detected whether or not empty chambers are stuffed by dummy plugs by bringing a contact switch or a detection pin of the connector terminal detecting tool into contact with the dummy plug and checking the result thereof. However, the reliability of this type of detection is not sufficient due to the above difference of the locations of the individual inserted dummy plugs.

SUMMARY OF THE INVENTION

The present invention has been made to solve the above-mentioned problems, and accordingly, it is an object of the present invention to provide a water-proof connector and dummy plugs for a water-proof connector, whereby it is easily and securely detected whether or not the dummy plugs are stuffed in the terminal chambers presently not in use.

In order to accomplish the above objective, a dummy plug for a water-proof connector according to the present invention comprises a shielding plug to be stuffed in a terminal accommodating chamber in a water-proof connector housing and a shielding plug holder, wherein the shielding plug holder is further composed of a lid portion which is formed larger than an inner diameter of the terminal accommodating chamber, a pushing projection for pushing the shielding plug formed on one side surface of the lid portion, and a housing locking section formed integrally with the lid portion. It is preferable to form the pushing projection for pushing the shielding plug with a shaft section protruded to be inserted into a lead wire through-hole formed in the shielding plug, or instead, the pushing projection itself can be eliminated by forming the lid portion with a shaft section which is directly protruded therefrom.

It is to be noted that each of the dummy plugs is locked with a corresponding empty terminal accommodating chamber of the water-proof connector engaging the housing locking section of the shielding plug holder with the connector housing.

With the construction above, since the lid portion or the housing locking section of the shielding plug holder can be seen from outside with the dummy plug inserted into the terminal accommodating chamber, the water-proof connector according to the present invention adopting the dummy plug can be checked easily whether or not the shielding plugs are stuffed in the empty terminal accommodating chambers. Also, since the shielding plug holder is locked by engaging the housing locking section thereof with a locking claw formed on the connector housing side, all ! the stuffed shielding plugs are settled at the substantially same position in each of the terminal accommodating chambers, thereby eliminating the conventional problem of the inconsistent locations of the stuffed shielding plugs. Thus, electrical conductiveness of the terminal of the water-proof connector as well as existence of stuffed dummy plugs can be checked simultaneously even by using a conventionally adopted connector terminal checking tool. In addition, since the shielding plug holder can be used without any modification to the conventional shielding plug having a lead wire through-hole in the center portion thereof, the device as a whole can be a substantially low cost product.

Other features and advantages of the invention will be apparent from the following description taken in connection with the accompanying drawing.

DETAILED DESCRIPTION OF THE PREFERRED EMBODIMENTS

Figure 1:
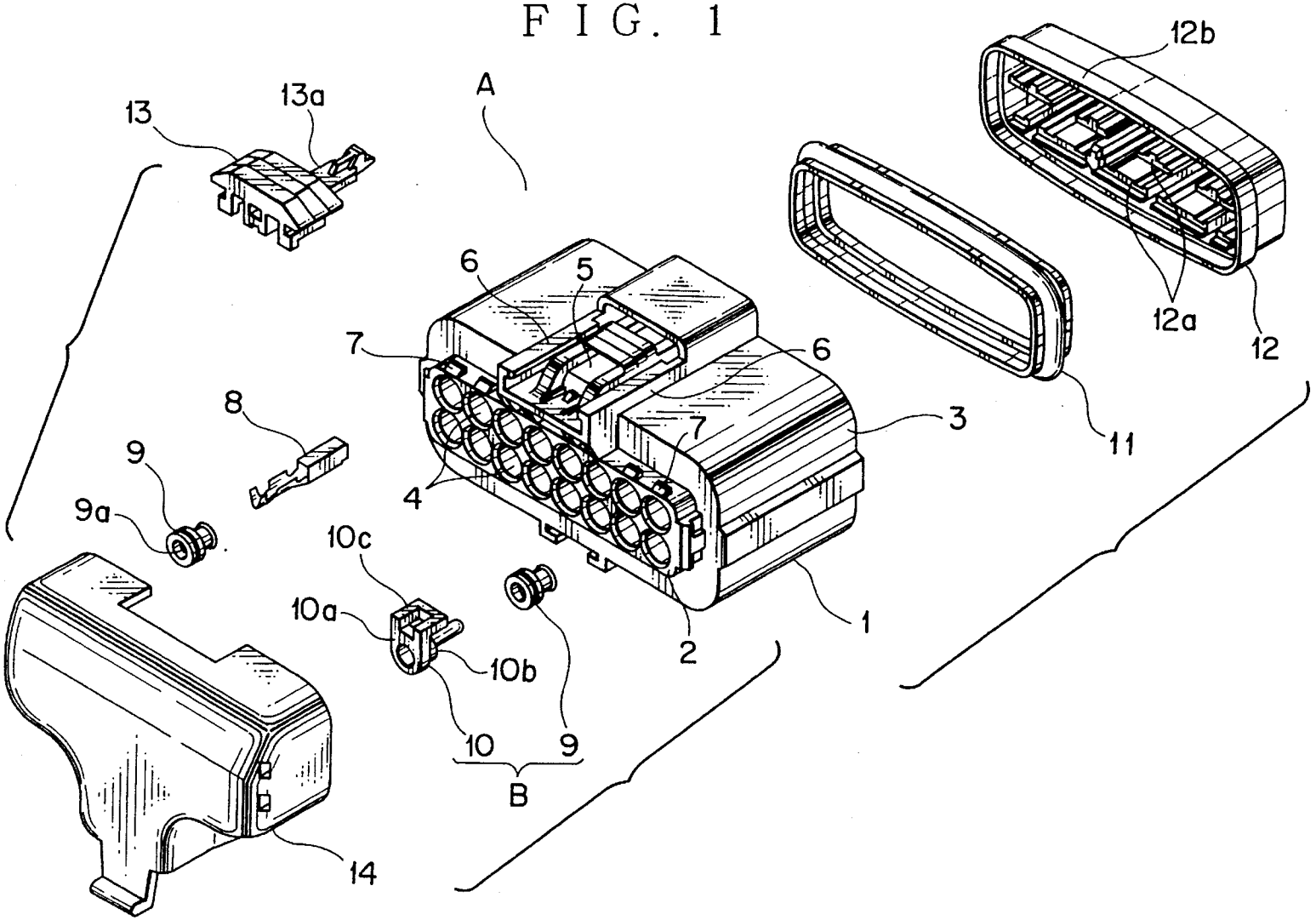
FIG. 1 is an exploded perspective view of a water-proof connector in one embodiment of the present invention.
Figure 2:
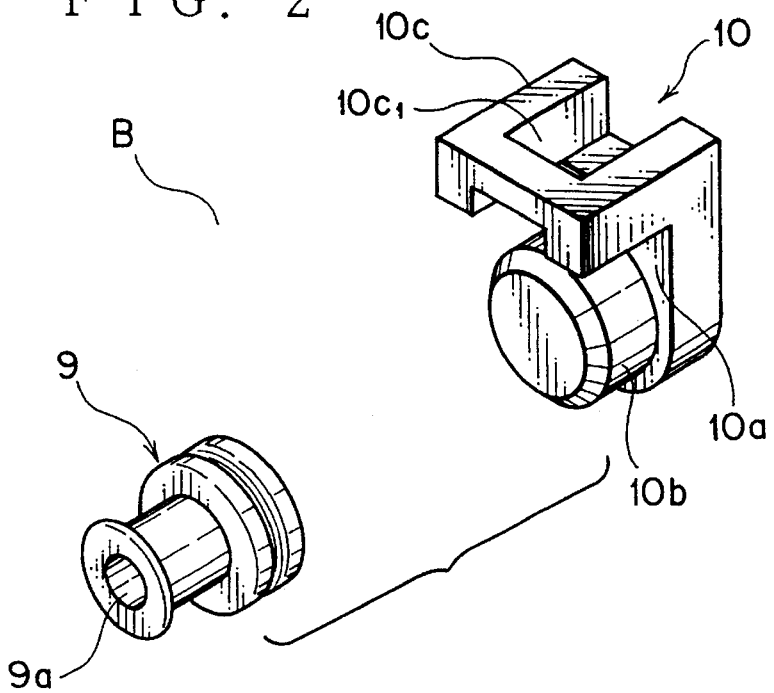
FIG. 2 is a magnified perspective view of the dummy plug shown in FIG. 1.
Figure 3:
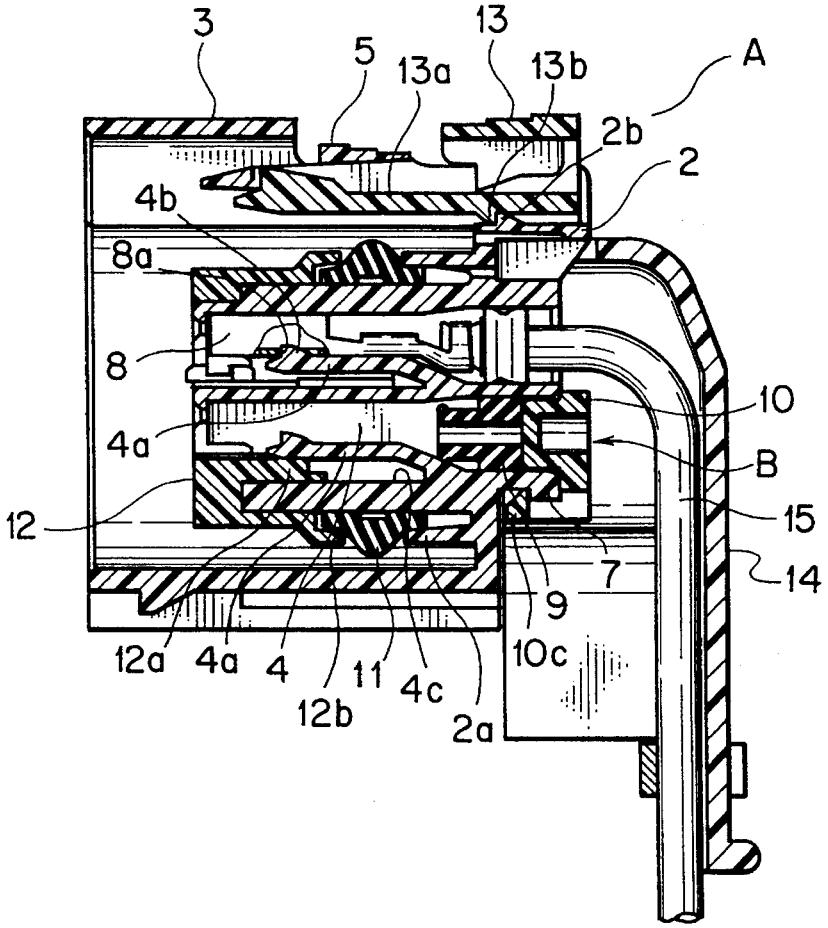
FIG. 3 is an illustration showing the sectional view of the connector of FIG. 1 in an assembled state.

In the following, several embodiments of the present invention are described with reference to the accompanying drawings, wherein FIG. 1 illustrates an exploded perspective view of a water-proof connector A, FIG. 2 shows a magnified perspective view of a dummy plug applied to the water-proof connector of FIG. 1, and FIG. 3 illustrates a connector A assembled with the dummy plug.

In FIG. 1, A denotes a water-proof connector, 1 denotes a female housing, 8 a female terminal, 9 a shielding plug, B a dummy plug, 11 a packing, 12 a terminal locking tool for reinforcing a locking force of the female terminal 8, 13 a double-locking member, and 14 denotes a housing cover.

Female housing 1 made of synthetic resin includes a hood 3 for receiving a male housing (not shown) on the external circumferential surface of the housing body 2. In housing body 2, a plurality of terminal accommodating chambers 4 are provided in vertically aligned two rows, a locking arm 5 for receiving the before-mentioned male housing is provided at the center portion of the upper circumferential wall of hood 3 together with a pair of protection walls 6 provided at the respective lateral sides thereof, and at the rear end circumferential surface of housing 2 locking claws 7 for locking corresponding dummy plugs B are provided.

According to FIG. 3, female terminal 8 inserted into an upper-side terminal accommodating chamber 4 is locked through engagement between a projection **4*b* of a flexible locking arm 4*a* provided inside terminal accommodating chamber 4 and a locking hole 8*a* of female terminal 8 to avoid rearward movement thereof, and a lead wire 15 connected to the female terminal 8 has been drawn out by way of a lead wire through-hole 9*a* which is formed in the center portion of the shielding (rubber) plug 9 stuffed inside the terminal accommodating chamber 4**.

In the same figure, the lower side terminal accommodating chamber 4 is empty, and thus dummy plug B is stuffed for shielding water. As shown in FIG. 2, a dummy plug B is composed of a before-mentioned shielding plug 9 and a shielding plug holder 10 supporting this shielding plug 9. The shielding plug holder 10 is made of synthetic resin material, which is further composed of a lid portion **10*a*, a pushing projection 10*b* for pushing the shielding plug 9 and a housing locking section 10*c***.

The pushing projection **10*b* is formed smaller than an inner diameter of the terminal accommodating chamber 4 so that it can be smoothly moved in to or out from the chamber, and is formed in such a length that the shielding plug holder 10 as a whole does not cause rattling when the housing locking section 10*c* is engaged with the before-mentioned locking claw 7 to be locked thereby. Further, the housing locking section 10*c* is integrally formed with the lid portion 10*a* which is larger than the inner diameter of terminal accommodating chamber 4, the housing locking section 10*c* being protruded from one end of the lid portion 10*a* in the same direction with the pushing projection 10*b* side thereby making an "L" shape. The housing locking section 10*c* constructed as such is used as a flexible locking piece having a locking hollow 10C1 to be engaged with the before-mentioned locking claw 7 of housing body 2**.

Dummy plug B, as shown in FIG. 2, can be constructed either by combining a shielding plug 9 and a shielding plug holder 10 as two individual different members, by preliminarily adhering the shielding plug 9 to the pushing projection **10*b* of the shielding plug holder 10, or by integrally molding the shielding plug 9 to the shielding plug holder 10**.

Referring now to FIGS. 1 to 3, a method for assembling the water-proof connector A is explained hereinafter.

First of all, as shown in FIG. 3 insert female terminal 8 together with shielding plug 9 into terminal accommodating chamber 4 and airtightly seal it, and in the empty chamber 4, insert dummy plug B, and then engage locking hollow 10C1 of housing locking section 10C with locking claw 7 provided on the external circumferential surface of housing body 2 to be locked thereby. Thereafter, fit packing 11 into the external surface of the front half portion of housing body 2, and then set a terminal locking tool 12 thereon from the frontward in order to firmly fix the packing 11 and also to reinforce the force to lock female terminal 8. In other words, terminal locking tool 12 is provided with a plurality of spacers to cope with each of the terminal accommodating chambers, and these spacers are inserted between flexible locking arm **4*a* which has locked female terminal 8 already and inner wall 4*c* of terminal accommodating chamber 4 to suppress vertical movement of the flexible locking arm 4*a*, thereby to reinforce the terminal locking force. By the way, the packing 11 is positioned and fixed between the flange portion 12*b* provided at the rear end portion of terminal locking tool 12*a* and a packing receiving groove 2*a* provided in the external circumferential wall of the housing body 2**.

Then, after inserting a double-locking member 13 from the rear end of locking arm 5 between a pair of protection walls 6, 6 of housing 1 to preliminarily lock it, set a housing cover 14 on it. It is to be noted that double-locking member 13 comprises an arm locking piece **13*a*, and if this double-locking member 13 is further pushed in the state that preliminarily the female housing 1 is firmly engaged with the before-mentioned male housing, a locking claw 2*b* and a locking claw 13*b* are engaged to be secondarily locked. Simultaneously, arm locking piece 13*a* is engaged with locking arm 5, whereby the lower movement of the arm 5** is prohibited and the locking force between two housings is thereby greatly raised.

An insertion of the dummy plug B into terminal accommodating chamber 4 is, in case shielding plug 9 and shielding plug holder 10 are individually separate members, executed such that first loosely fit the shielding plug 9 into terminal accommodating chamber 4, and then push the thus fitted shielding plug 9 with pushing projection **10*b* of a shielding plug holder 10, and thereafter abut the lid portion 10*a* thereof to the rear end face of terminal accommodating chamber 4, and lock it with the housing body 2 by the housing locking section 10*c***.

Since the shielding plug is pressed by pushing projection **10*b* of the shielding plug holder 10, it is pushed always up to the same depth from the rear (front) end of the terminal accommodating chamber 4. Further, since pushing projection 10*b* is resiliently contacted to the shielding plug 9 to tightly close the lead wire through-hole 9*a*, there will be no fear of water invasion thereinto. Still further, the shielding plug holder 10 can be locked safely by an engagement between housing locking section 10*c* thereof and locking claw 7, since the top end of the pushing projection 10*b* is led to a right position by fitting with the shielding plug 9, so that the pushing projection 10*b* is substantially aligned with the terminal accommodating chamber 4. It is to be noted that even a non-hole type shielding plug can be used instead of the above shielding plug 9 having lead wire through-hole 9*a***.

As explained heretofore, as the water-proof connector A and dummy plug B in an assembled state can be recognized such that lid portion **10*a* or housing locking section 10*c* of the shielding plug holder 10 is exposed from the rear end portion of the female housing 1, it can be easily checked whether or not the terminal accommodating chambers are stuffed with dummy plugs. Further, since the shielding plug 9 is inserted up to the almost same depth in each of the terminal accommodating chambers 4**, it can also be easily detected whether or not the terminals are electrically conductive or whether dummy plugs are stuffed in empty terminal accommodating chambers, but only using a conventional connector terminal detecting tool as disclosed in the above-mentioned Japanese Patent Publication No. 2-56786, or through the modification thereof.

Figure 4:
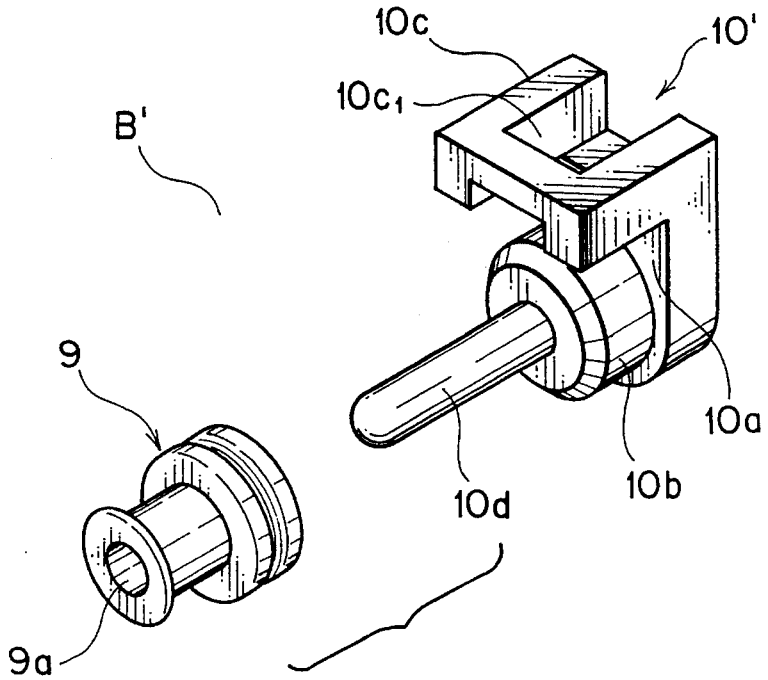
FIG. 4 is a perspective view of a dummy plug in another embodiment of the present invention.
Figure 5:
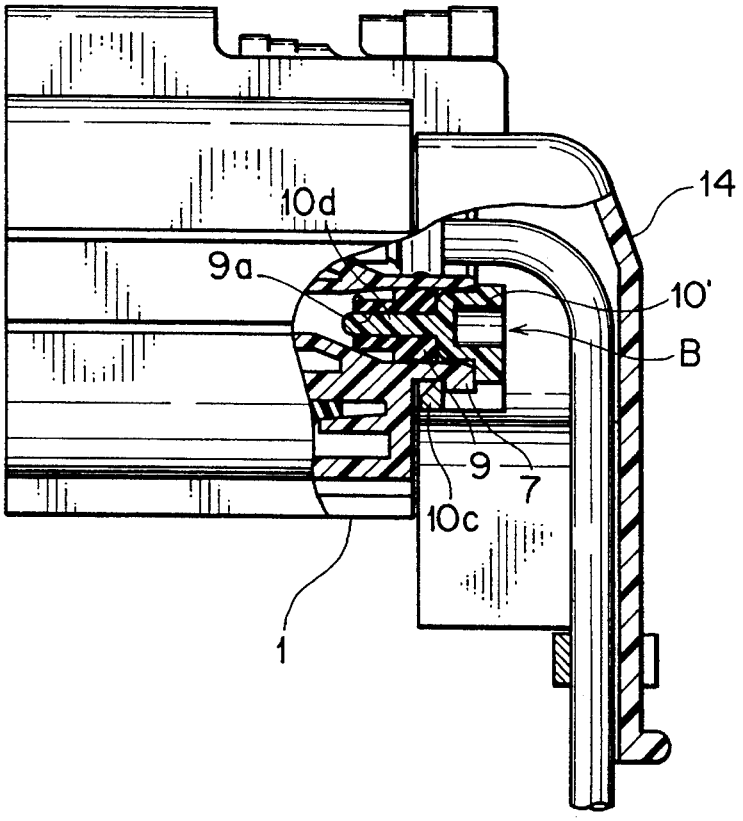
FIG. 5 is a partially sectional view showing the state that the dummy plug of FIG. 4 is stuffed in the water-proof connector.

FIG. 4 is a perspective view of a dummy plug in another embodiment of the present invention, and FIG. 5 is a partial sectional view of a water-proof connector in which the dummy plug is stuffed. In the figures, a shielding plug holder 10' for a dummy plug B' is a modification of the shielding plug holder 10 of FIG. 2, wherein a shaft **10*d* to be inserted into a lead wire through-hole 9*a* of the shielding plug 9 is protruded from the center of a pushing projection 10*b*. This dummy plug B' can be also constructed either by manufacturing the shielding plug 9 and the shielding plug holder 10' individually, or by integrally molding the shielding plug 9 to the shielding plug holder 10'**.

For inserting dummy plug B' to the terminal accommodating chamber 4, there are three methods such as; loosely fit shielding plug 9 into terminal accommodating chamber 4, and thereafter press a shaft **10*d* against the lead wire through-hole 9*a* as a first method, insert the shaft 10*d* into the through-hole 9*a* to preliminarily attach the shielding plug 9 to the shielding plug holder 10', and thereafter fit the thus attached members into the terminal accommodating chamber 4 as a second method, and integrally mold the shielding plug 9 first into the shielding plug holder 10', and thereafter fit the molded members into the chamber 4 as a third method. By any of these methods, since the lid portion 10*a* is, just like the above shielding plug holder 10 of FIG. 2, abutted to the rear end face of the terminal accommodating chamber 4, and pushing projection 10*b* pushes shielding plug 9, the shielding plug 9 is always settled at the substantially same position respectively in each of the terminal accommodating chambers 4. The shaft 10*d* of dummy plug B', as shown in FIG. 5, penetrates through the lead wire through-hole 9*a*, and accordingly, the dummy plug B' is supported not only by the housing locking section 10*c* which is engaged with the locking claw 7, but also by the shaft 10*d***, whereby water-proofing function and the locking force can be both greatly increased compared with the case of dummy plug B.

Figure 6:
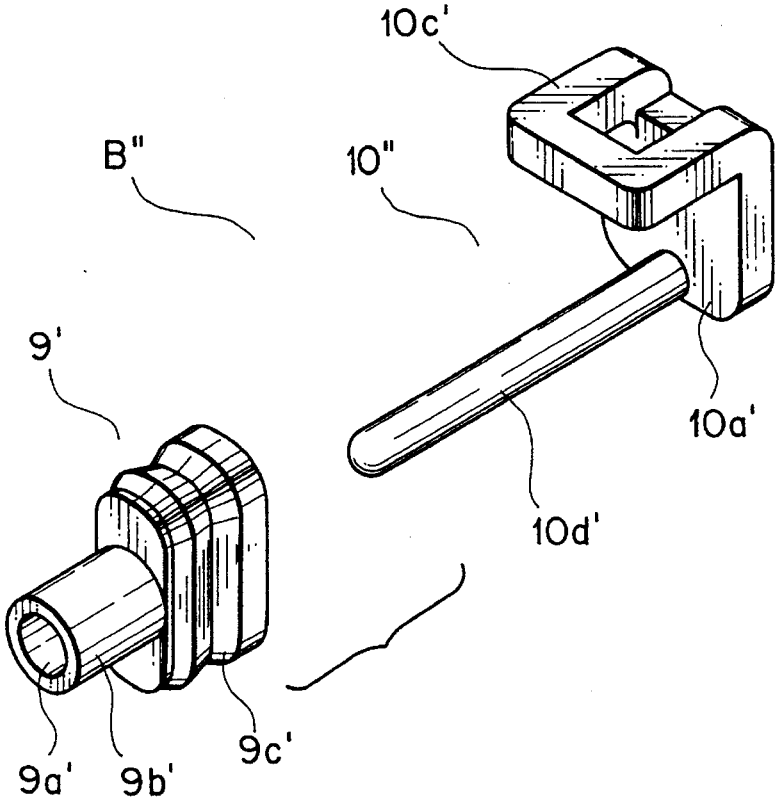
FIG. 6 is a perspective view of a dummy plug in further embodiment of the present invention.
Figure 7:
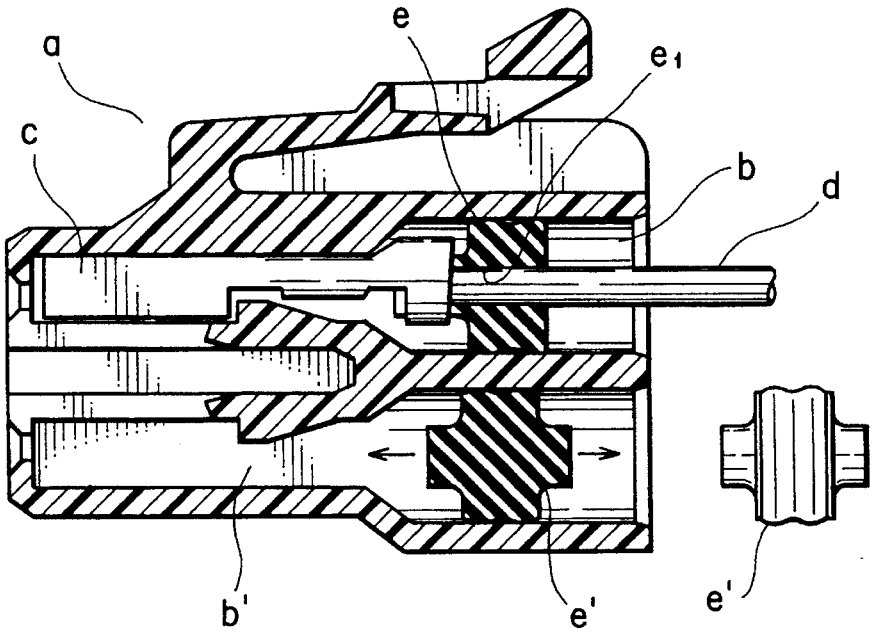
FIG. 7 PRIOR ART
FIG. 7 is an explanatory view illustrating a conventional water-proof connector and a dummy plug to be stuffed therein.

FIG. 6 is a perspective view of a dummy plug in another embodiment of the present invention, wherein a shielding plug 9' of a dummy plug B" is constructed such that a plug body **9*c'*, supporting a hollow tube 9*b'* and having a lead wire through-hole 9*a'*, is formed as a parallelopiped rectangular with the respective corners rounded off, whereas a shielding plug holder 10" is constructed such that a shaft 10*d'* is directly protruded from a lid portion 10*a'* having a housing locking section 10*c'*. This way, by modifying or avoiding the pushing projection 10*b* in compliance with the shape of the corresponding shielding plug, the position of a shielding plug 9 or 9'** can be settled at a constant distance from the front (rear) end of the terminal accommodating chamber.

[Effect of the Invention]

As explained heretofore, according to a water-proof connector and a dummy plug of the present invention, the existence of a dummy plug can be readily but securely detected, and since it can be electrically checked by only a slight modification of an already known connector terminal detecting tool, the manufacturing cost thereof can be substantially suppressed.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A dummy plug comprising:

a shielding plug to be inserted into unused terminal accommodating chambers provided in a connector housing of a water-proof connector, and a shielding plug holding means for pushing said shielding plug into the unused terminal accommodating chambers, wherein said shielding plug holding means includes a lid portion, a pushing projection for pushing said shielding plug into the terminal accommodating chambers formed on one side surface of said lid portion, and a housing locking section formed integrally with said lid portion, locking said shielding plug holding means to the connector housing.

2. A dummy plug as claimed in claim 1, wherein said pushing projection is further formed with a shaft portion protruded therefrom to be inserted into a lead wire through-hole provided in said shielding plug, said shaft portion being protruded from said pushing projection.

3. A dummy plug comprising:

a shielding plug to be inserted into unused terminal accommodating chambers provided in a connector housing of a water-proof connector, and a shielding plug holding means for pushing said shielding plug into the unused terminal accommodating chambers, wherein said shielding plug holding means includes a lid portion, a shaft portion to be inserted into a lead wire throughhole provided in said shielding plug, said shaft being protruded directly from said lid portion, and a housing locking section formed integrally with said lid portion, locking said shielding plug holding means to the connector housing.

4. A water-proof connector for receiving terminals inserted in a plurality of terminal accommodating chambers provided in a connector housing, wherein lead wires each of which is coupled to the respective terminals is drawn out through a lead wire through-hole provided in a shielding plug that airtightly covers each of said terminal accommodating chambers, while a dummy plug is stuffed in each of the empty terminal accommodating chambers where no terminal is inserted, said dummy plug being composed of a shielding plug to be inserted in each of said empty terminal accommodating chambers and a shielding plug holding means, said shielding plug holding means further comprising;

a lid portion which is formed larger than an inner diameter of each of said terminal accommodating chambers, a pushing projection for pushing said shielding plug formed on one side surface of said lid portion, and a housing locking section formed integrally with said lid portion, wherein said dummy plug is locked to each of said empty terminal accommodating chambers by an engagement between said housing locking section and said connector housing.

5. A water-proof connector for receiving terminals inserted in a plurality of terminal accommodating chambers provided in a connector housing, wherein lead wires each of which is coupled to the respective terminals is drawn out through a lead wire through-hole provided in a shielding plug that airtightly covers each of said terminal accommodating chambers, while a dummy plug is stuffed in each of the empty terminal accommodating chambers where no terminal is inserted, said dummy plug being composed of a shielding plug to be inserted in each of said empty terminal accommodating chambers and a shielding plug holding means, said shielding plug holding means further comprising;

a lid portion which is formed larger than an inner diameter of each of said terminal accommodating chambers, a shaft portion to be inserted into a lead wire through-hole provided in said shielding plug, said shaft being protruded directly from said lid portion, and a housing locking section formed integrally with said lid portion, wherein said dummy plug is locked to each of said empty terminal accommodating chambers by an engagement between said housing locking section and said connector housing.

6. A water-proof connector as claimed in claim 4 or 5, wherein said connector housing is further provided with locking claws to be engaged with each of the housing locking sections of said dummy plug.

* * * * *